US007634207B2

(12) United States Patent
Miyamoto et al.

(10) Patent No.: US 7,634,207 B2
(45) Date of Patent: Dec. 15, 2009

(54) IMAGE FORMING APPARATUS AND IMAGE FORMING METHOD

(75) Inventors: Yoko Miyamoto, Kanagawa (JP); Takashi Hoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 259 days.

(21) Appl. No.: 11/785,422

(22) Filed: Apr. 17, 2007

(65) Prior Publication Data

US 2008/0025744 A1 Jan. 31, 2008

(30) Foreign Application Priority Data

Jul. 28, 2006 (JP) ..... 2006-206534

(51) Int. Cl.
*G03G 15/16* (2006.01)

(52) U.S. Cl. ..... 399/66; 399/299; 399/302

(58) Field of Classification Search ..... 399/43, 399/66, 299, 302
See application file for complete search history.

(56) References Cited

U.S. PATENT DOCUMENTS

2004/0190919 A1 9/2004 Iwasaki et al. ..... 399/45
2006/0067729 A1 3/2006 Ikeda et al. ..... 399/101
2006/0127115 A1 6/2006 Iwasaki et al. ..... 399/66
2006/0210326 A1 * 9/2006 Takehara et al. ..... 399/302

FOREIGN PATENT DOCUMENTS

| | | |
|---|---|---|
| JP | 2001-154561 | 6/2001 |
| JP | 2005-17864 | 1/2005 |
| JP | 2005-107118 | 4/2005 |
| JP | 2005-148198 | 6/2005 |

* cited by examiner

*Primary Examiner*—David M Gray
*Assistant Examiner*—Barnabas T Fekete
(74) *Attorney, Agent, or Firm*—Morgan, Lewis & Bockius LLP

(57) ABSTRACT

The present invention provides an image forming apparatus. The image forming apparatus includes plural image carriers, an endless intermediate transfer belt, plural first transfer members and a second transfer member. The image forming apparatus starts application of the transfer bias sequentially from the first transfer members disposed upstream and continues to apply the transfer bias to two or more of the first transfer members until the recording medium enters a transfer position where the toner images are transferred by the second transfer member.

7 Claims, 8 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2006-206534 filed Jul. 28, 2006.

BACKGROUND

1. Technical Field

The present invention relates to an image forming apparatus and an image forming method.

2. Related Art

Electrophotographic image forming apparatus are known which sequentially transfer and superpose, on an endless intermediate transfer belt, respective color toner images formed on plural photoconductor drums to form a full-color toner image and which cause the full-color toner image on the intermediate transfer belt to be transferred all at once to a recording medium.

Incidentally, given that primary transfer is the transfer of the respective color toner images from the photoconductor drums to the intermediate transfer belt and that secondary transfer is the transfer of the full-color toner image from the intermediate transfer belt to the recording medium, sometimes the speed of the intermediate transfer belt varies when relatively thick recording paper enters the secondary transfer position and is accompanied by shock.

It is known that when the speed of the intermediate transfer belt varies in this manner, an image quality defect called "banding" occurs in which image density varies in the moving direction of the intermediate transfer belt.

Thus, control of variations in the speed of the intermediate transfer belt and methods of controlling banding accompanying variations in speed have been disclosed.

SUMMARY

According to an aspect of the invention, there is provided an image forming apparatus comprising: a plurality of image carriers that carry toner images; an endless intermediate transfer belt to which the toner images of the plurality of image carriers are sequentially transferred; a plurality of first transfer members that are disposed in positions facing the image carriers, with the intermediate transfer belt being interposed therebetween, and to which a transfer bias is applied to cause the toner images to be transferred from the image carriers to the intermediate transfer belt; and a second transfer member that causes the toner images to be transferred from the intermediate transfer belt to a recording medium, wherein the image forming apparatus starts application of the transfer bias sequentially from the first transfer members disposed upstream and continues to apply the transfer bias to at least two of the first transfer members until the recording medium at least enters a transfer position where the toner images are transferred by the second transfer member.

BRIEF DESCRIPTION OF THE DRAWINGS

An exemplary embodiment of the present invention will be described in detail based on the following figures, wherein.

DETAILED DESCRIPTION

Figure 1:
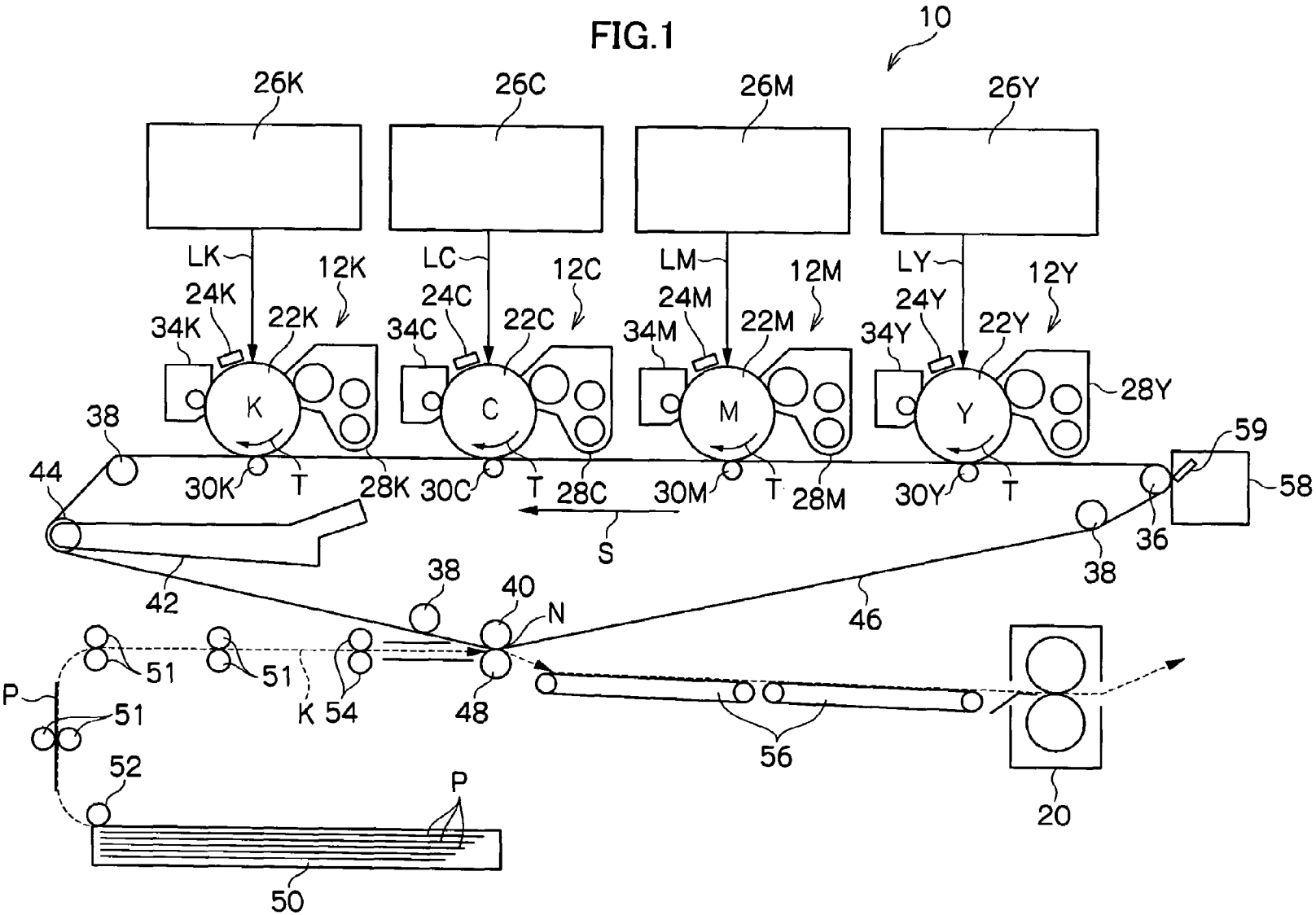
FIG. 1 is a diagram showing the schematic configuration of an image forming apparatus of the exemplary embodiment of the present invention.

An image forming apparatus 10 pertaining to an exemplary embodiment of the present invention will be described.

The image forming apparatus 10 is a tandem full-color printer that forms a full-color image on a recording medium P by sequentially transferring and superposing, on an endless intermediate transfer belt 46, respective color toner images for yellow (Y), magenta (M), cyan (C), and black (K) by an electrophotographic system to form a full-color toner image on the intermediate transfer belt 46 and transferring this full-color toner image all at once to the recording medium P.

Toner image forming units 12Y to 12K respectively corresponding to the four colors of yellow (Y), magenta (M), cyan (C), and black (K) are disposed in the image forming apparatus 10. The toner image forming units 12Y to 12K are respectively disposed with photoconductor drums 22Y to 22K serving as image carriers that rotate in the direction of arrow T. Charging devices 24Y to 24K, developing devices 28Y to 28K, and cleaning devices 34Y to 34K are disposed around the photoconductor drums 22Y to 22K. Further, the photoconductor drums 22Y to 22K are exposed by light scanning devices 26Y to 26K.

The endless intermediate transfer belt 46 is disposed so as to be contacted by the surfaces of the photoconductor drums 22Y to 22K. Primary transfer rolls 30Y to 30K serving as primary transfer members are respectively disposed in correspondence to the photoconductor drums 22Y to 22K, with the intermediate transfer belt 46 being interposed therebetween (i.e., the intermediate transfer belt 46 is interposed between the photoconductor drums 22Y to 22K and the primary transfer rolls 30Y to 30K). Further, the endless intermediate transfer belt 46 is wrapped around a drive roll 36, plural driven rolls 38, a backup roll 40, and a tension roll 44 of an anti-slanting device 42.

The intermediate transfer belt 46 rotates in the direction represented by arrow S. Further, the photoconductor drums 22Y to 22K are juxtaposed equidistantly with respect to the rotational direction of the intermediate transfer belt 46 in the order of the photoconductor drum 22Y, the photoconductor drum 22M, the photoconductor drum 22C, and the photoconductor drum 22K. In other words, the photoconductor drum 22Y (the toner image forming unit 12Y) is disposed most upstream and the photoconductor drum 22K (the toner image forming unit 12K) is disposed most downstream with respect to the rotational direction of the intermediate transfer belt 46.

It will be noted that, for the intermediate transfer belt 46, a belt comprising a resin such as polyimide, polycarbonate, or polyamide to which have been added appropriate quantities of an antistatic agent such as carbon black or a conductive resin such as polyaniline, and whose volume resistance has been set to about $10^6$ to $10^{14}$ Ω·cm and whose thickness has been set to about 0.1 mm, for example, is used.

The backup roll 40 is disposed downstream of the downstream-most photoconductor drum 22K (the toner image forming unit 12K). A secondary transfer roll 48 serving as a secondary transfer member is disposed such that the intermediate transfer belt 46 is interposed between the backup roll 40 and the secondary transfer roll 48.

Next, the process of image formation will be described.

The surfaces of the photoconductor drums 22Y to 22K are uniformly charged respectively by the charging devices 24Y to 24K. The charged surfaces of the photoconductor drums 22Y to 22K are exposed to respective color light beams LY to LK corresponding to output images from the light scanning devices 26Y to 26K, and electrostatic latent images are formed on the photoconductor drums 22Y to 22K. The electrostatic latent images on the photoconductor drums 22Y to 22K are developed by the developing devices 28Y to 28K, and respective color toner images are formed on the photoconductor drums 22Y to 22K.

The respective color toner images on the photoconductor drums 22Y to 22K are primarily transferred onto the intermediate transfer belt 46 as a result of a primary transfer bias of the opposite polarity of the charge polarity of the toner being applied sequentially from upstream to the primary transfer rolls 30Y to 30K. Then, the respective color toner images are primarily transferred and superposed sequentially from upstream, whereby a full-color toner image is formed on the intermediate transfer belt 46.

It will be noted that residual toner that remains on the photoconductor drums 22Y to 22K without being transferred to the intermediate transfer belt 46 is removed by the cleaning devices 34Y to 34K.

It will be noted that the photoconductor drums 22Y to 22K rotate at a speed that is slightly slower than that of the intermediate transfer belt 46. The reason for this is to improve transfer efficiency and improve stabilization by utilizing shear force to scrape off the respective color toner images on the photoconductor drums 22Y to 22K and perform primary transfer.

The full-color toner image formed on the intermediate transfer belt 46 in this manner moves to a nip portion N between the secondary transfer roll 48 and the intermediate transfer belt 46 on a conveyance path K of the recording medium P in accompaniment with the rotation of the intermediate transfer belt 46.

A tray 50 in which the sheet-like recording medium P is stacked and stored is disposed in the lower portion of the image forming apparatus 10. The recording medium P stored in the tray 50 is fed one sheet at a time by a feed roll 52. The fed recording medium P is conveyed by plural conveyance roll pairs 51. Then, the recording medium P is sent to the nip portion N between the secondary transfer roll 48 and the intermediate transfer belt 46 at a predetermined timing by registration rolls 54 disposed in front of the secondary transfer roll 48. After feeding the leading edge of the recording medium P a predetermined distance to the nip portion N, the registration rolls 54 stop feeding operation (the nip between the registration roll pair is opened).

A secondary transfer bias of the opposite polarity of the charge polarity of the toner is applied to the secondary transfer roll 48 in accordance with the timing when the recording medium P enters the nip portion N. Then, when the recording medium P passes through the nip portion N, the full-color toner image on the intermediate transfer belt 46 is secondarily transferred to the recording medium P.

The recording medium P to which the full-color toner image has been transferred is conveyed to a fixer 20 by conveyor belts 56. Then, after the full-color toner image has been fixed to the recording medium P by the fixer 20, the recording medium P is discharged into a paper discharge tray.

It will be noted that residual toner that remains on the intermediate transfer belt 46 without being transferred to the recording medium P is removed by a blade 59 of a belt cleaner 58 disposed between the nip portion N and the upstream-most toner image forming unit 12Y.

Next, the rotational loads of the intermediate transfer belt 46 will be described.

The intermediate transfer belt 46 is driven to rotate in a state where it has mainly the following rotational loads.

(1) A brake effect resulting from the pushing of the blade 59 of the belt cleaner 58 against the intermediate transfer belt 46.

(2) A brake effect (small) resulting from the rotational torques of the stretching rolls (the drive roll 36, the rolls 38 that rotate following the rotation of the drive roll 36, the backup roll 40, and the tension roll 44).

(3) A brake effect resulting from the rotational torque of the secondary transfer roll 48 (mainly the load of a secondary transfer roll cleaner).

(4) A brake effect resulting from the photoconductor drums 22Y to 22K and the intermediate transfer belt 46 sliding against each other, and the rotational torques of the photoconductor drums 22Y to 22K (resulting from the photoconductor drums 22Y to 22K rotating at a speed that is slightly slower than that of the intermediate transfer belt 46).

When the rotational loads of aforementioned (1) to (4) are reduced, it becomes easier for the rotational speed of the intermediate transfer belt 46 to be affected by noise from the outside. For this reason, sometimes the speed of the intermediate transfer belt 46 varies when relatively thick recording medium P enters the nip portion N and shock is imparted.

It is known that when the speed of the intermediate transfer belt 46 varies, an image quality defect called "banding" occurs in which image density varies in the moving direction of the intermediate transfer belt 46.

Thus, in the present exemplary embodiment, a reduction in the rotational load imparted by the "brake effect resulting from the photoconductor drums 22Y to 22K and the intermediate transfer belt 46 sliding against each other, and the rotational torques of the photoconductor drums 22Y to 22K" of aforementioned (4) is controlled so that variations in the speed of the intermediate transfer belt 46 are controlled.

Additionally, in the present exemplary embodiment, a reduction in the rotational load of (4) is controlled by controlling the timings when the primary transfer bias is applied to the primary transfer rolls 30Y to 30K. Thus, next, control of the timings when the primary transfer bias is applied to the primary transfer rolls 30Y to 30K will be described.

First, conventional control of the timings when the primary transfer bias are applied to the primary transfer rolls 30Y to 30K will be described.

Figure 8:
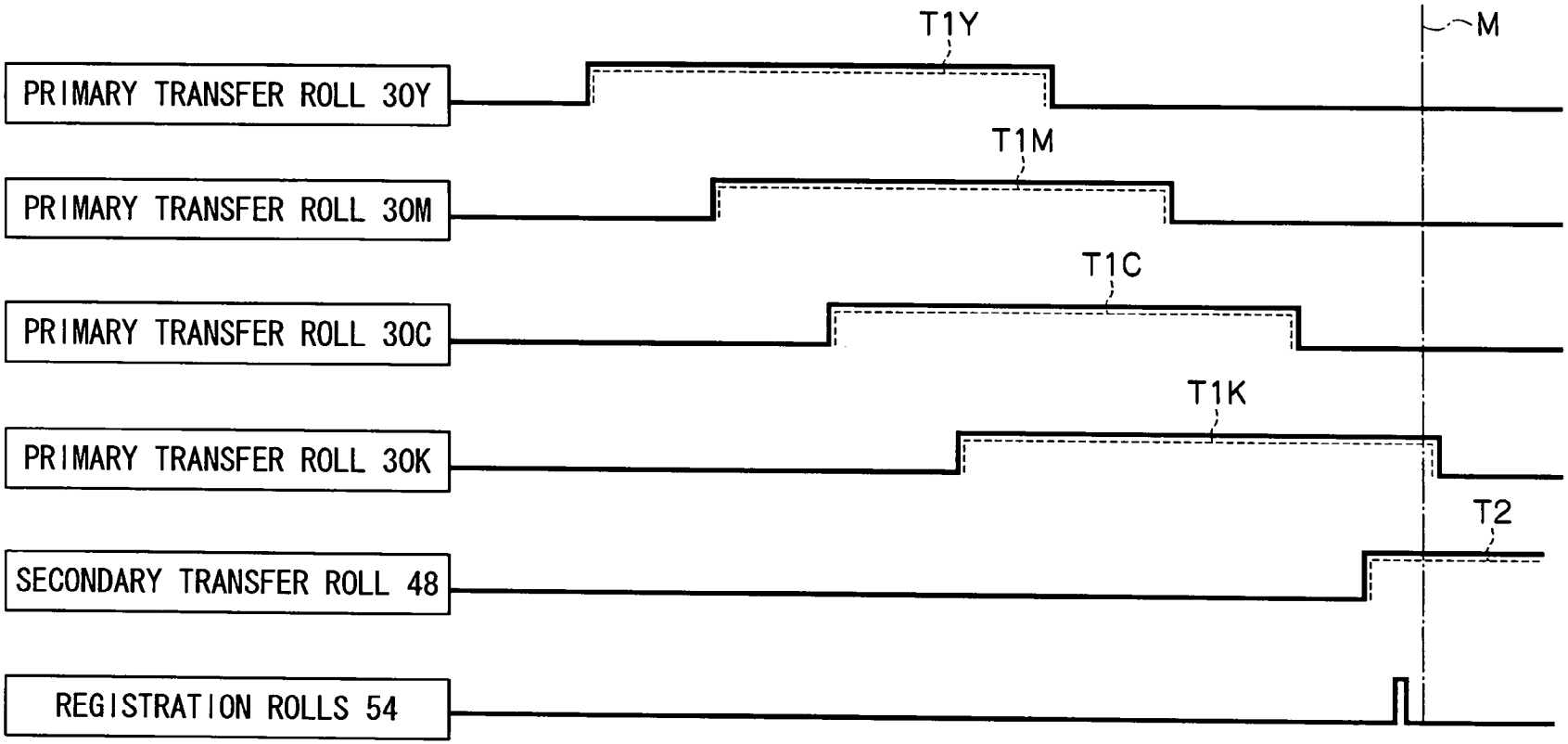
FIG.8 RELATED ART
FIG. 8 is a diagram showing a timing chart of a control method of related art.

FIG. 8 is a conventional timing chart.

Specifically, FIG. 8 is a timing chart showing the timings when the primary transfer bias is applied to the primary transfer rolls 30Y to 30K, the timing when the secondary transfer bias is applied to the secondary transfer roll 48, and the timing when the registration rolls 54 feed the recording medium P to the nip portion N. It will be noted that up represents when application is ON and down represents when application is OFF.

Further, dotted lines T1Y to T1K in the timing chart represent the timings when the respective color toner images on the photoconductor drums 22Y to 22K are being primarily transferred to the intermediate transfer belt 46. Further, dotted line T2 in the timing chart represents the timing when the toner image on the intermediate transfer belt 46 is being secondarily transferred to the recording medium P. Further, dashed line M represents the timing when the recording medium P enters the nip portion N.

As shown in FIG. 8, application of the primary transfer bias to the primary transfer rolls 30Y to 30K is started sequentially from upstream to primarily transfer the respective color toner images on the photoconductor drums 22Y to 22K to the intermediate transfer belt 46. Additionally, application of the primary transfer bias is ended sequentially from upstream in accordance with the timing when primary transfer (T1Y to T1K) of the toner images on the photoconductor drums 22Y to 22K to the intermediate transfer belt 46 ends. It will be noted that, even when secondary transfer (T2) is started, application of the primary transfer bias continues with respect to just the downstream-most primary transfer roll 30K because primary transfer has not ended. In other words, when the recording medium P enters the nip portion N (dashed line M), the primary transfer bias is being applied to just the primary transfer roll 30K.

When the primary transfer bias is not being applied to the primary transfer rolls 30Y, 30M, and 30C, the force of attraction between the intermediate transfer belt 46 and the photoconductor drums 22Y, 22M, and 22C is greatly weakened. Thus, the brake effect from the photoconductor drums 22Y, 22M, and 22C of aforementioned (4) becomes significantly smaller. As a result, the rotational load of the intermediate transfer belt 46 is reduced.

For this reason, it becomes easier for the rotational speed of the intermediate transfer belt 46 to be affected by noise from the outside. Thus, the speed of the intermediate transfer belt 46 varies when a relatively thick recording medium P enters the nip portion N and shock is imparted. Further, although the registration rolls 54 stop feeding operation at a timing when they have fed the leading edge of the recording medium P a predetermined distance to the nip portion N, the speed of the recording medium P varies at that time. Particularly when the recording medium P is relatively thick, sometimes this variation in speed also causes variation in the speed of the intermediate transfer belt 46. When the speed of the intermediate transfer belt 46 varies in this manner, sometimes primary transfer (T1K) from the photoconductor drum 22K where primary transfer has not ended to the intermediate transfer belt 46 is disrupted and "banding" occurs.

Thus, next, a first method of controlling the application timings of the primary transfer bias that controls variations in the speed of the intermediate transfer belt 46 will be described.

Figure 2:
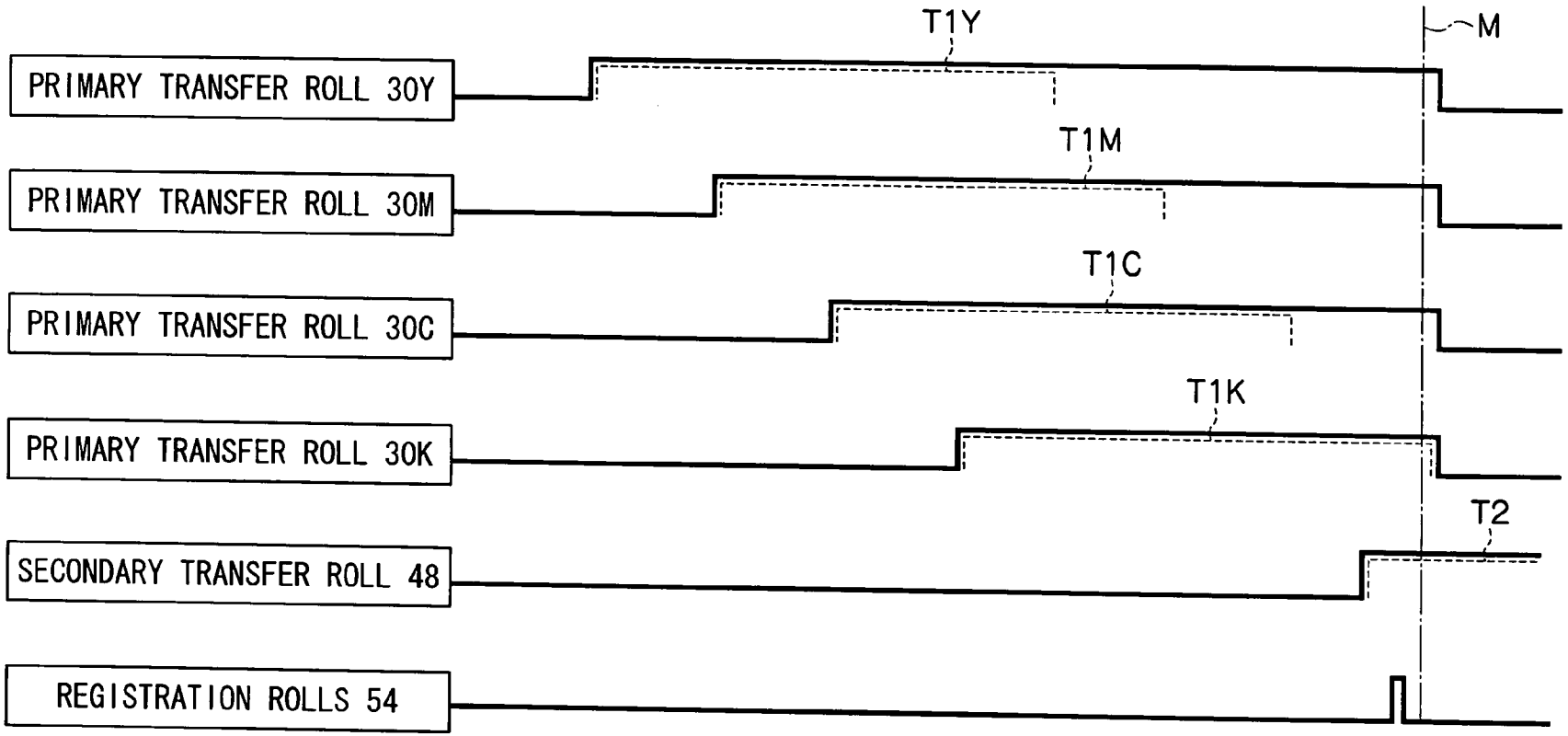
FIG. 2 is a diagram showing a timing chart of a first control method.

FIG. 2 is a timing chart showing the first control method. It will be noted that description that is redundant with the content described in the conventional timing chart (FIG. 8) will be omitted.

As shown in FIG. 2, application of the primary transfer bias to the primary transfer rolls 30Y to 30K is started sequentially from upstream to primarily transfer the respective color toner images on the photoconductor drums 22Y to 22K to the intermediate transfer belt 46.

Then, even when primary transfer (T1Y, T1M, T1C) to the photoconductor drums 22Y, 22M, and 22C ends, the primary transfer bias continues to be applied to the primary transfer rolls 30Y, 30M, and 30C until application to the downstream-most primary transfer roll 30K ends (i.e., the timing when application of the primary transfer bias to the downstream-most primary transfer roll 30K ends and the timing when application of the primary transfer bias to the other primary transfer rolls 30Y, 30M, and 30C ends are made substantially the same).

In other words, as represented by the dashed line M, the primary transfer bias is being applied to all of the primary transfer rolls 30Y to 30K until the recording medium P enters (when the recording medium P has entered) the nip portion N.

Thus, the brake effect from the photoconductor drums 22Y, 22M, and 22C is maintained without the force of attraction between the intermediate transfer belt 46 and the photoconductor drums 22Y, 22M, and 22C being weakened. In other words, the rotational load is not reduced.

Consequently, variations in the speed of the intermediate transfer belt 46 are controlled even when a relatively thick recording medium P enters the nip portion N and shock is imparted. Thus, "banding" is controlled without primary transfer (T1K) from the photoconductor drum 22K to the intermediate transfer belt 46 being disrupted.

In the above description, the timing when application of the primary transfer bias to the downstream-most primary transfer roll 30K ends and the timings when application of the primary transfer bias to the other primary transfer rolls 30Y, 30M, and 30C ends are made substantially the same, but the present invention is not limited to this. The timing when application of the primary transfer bias to the other primary transfer rolls 30Y, 30M, and 30C ends may also be earlier or later than the timing when application of the transfer bias to the downstream-most primary transfer roll 30K ends. Further, the timings when application of the primary transfer bias to the primary transfer rolls 30Y, 30M, and 30C ends do not have to be substantially the same (i.e., application of the transfer bias to the primary transfer rolls 30Y, 30M, and 30C may end at separate timings).

What matters is that the primary transfer bias continues to be applied also to the other primary transfer rolls 30Y, 30M, and 30C until the recording medium P enters (when the recording medium P has entered) the nip portion N.

Moreover, although the primary transfer bias continues to be applied to all of the other primary transfer rolls 30Y, 30M, and 30C until application of the primary transfer bias to the downstream-most primary transfer roll 30K ends, the present invention is not limited to this. It suffices for at least the primary transfer bias to continue to be applied to at least one of the primary transfer rolls 30Y, 30M, and 30C.

Figure 3:
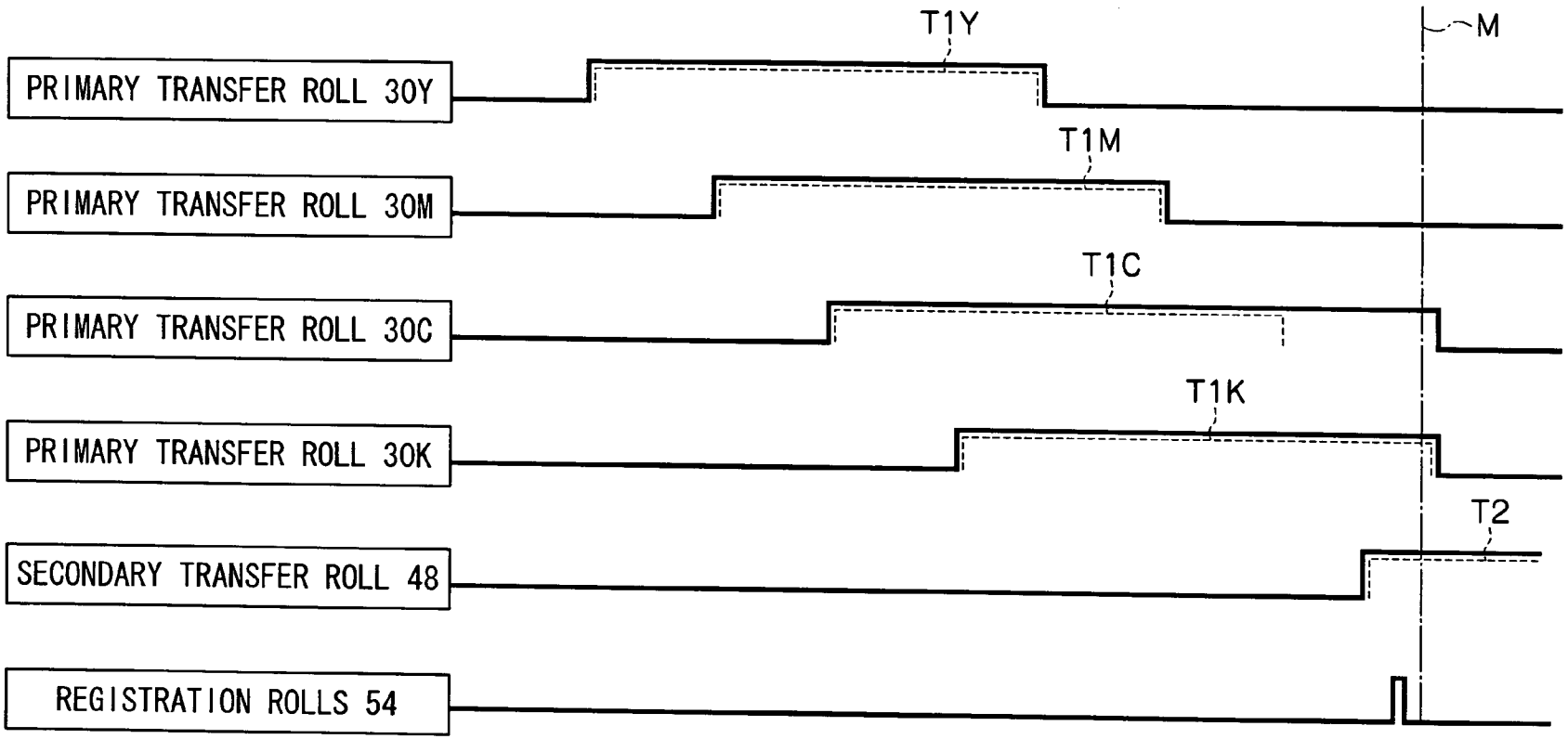
FIG. 3 is a diagram showing a timing chart of a modification of the first control method.
Figure 4:
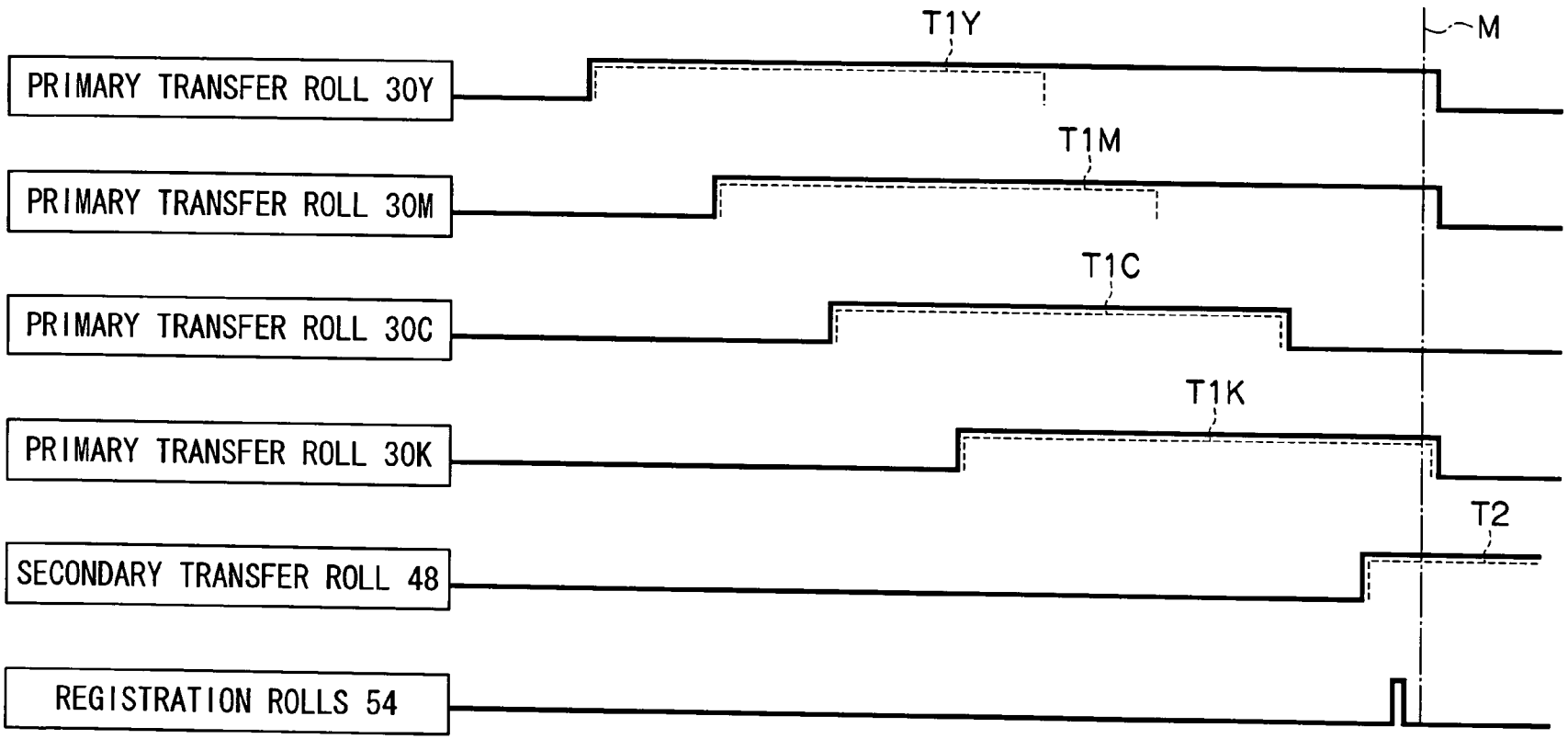
FIG. 4 is a diagram showing a timing chart of a modification of the first control method.

For example, as shown in FIG. 3, the primary transfer bias may continue to be applied to just the primary transfer roll 30C. Or, as shown in FIG. 4, the primary transfer bias may continue to be applied to the two primary transfer rolls 30Y and 30M. What matters is that the primary transfer bias continues to be applied to any one or more of the other primary transfer rolls 30Y, 30M, and 30C until the recording medium P enters (when the recording medium P has entered) the nip portion N. It will be noted that the effect of controlling variations in the speed of the intermediate transfer belt 46 is greatest when the primary transfer bias continues to be applied to any two or more (and all three if possible) of the primary transfer rolls 30Y, 30M, and 30C.

Incidentally, continuing to apply a primary transfer bias to a primary transfer roll that has not transferred a toner image means that the load on the corresponding photoconductor drum becomes greater and the life span of the photoconductor drum becomes shorter.

Thus, as shown in FIG. 3 and FIG. 4, reductions in the life spans of the photoconductor drums are kept to a minimum by continuing to apply the primary transfer bias to just one or two of the primary transfer rolls 30Y, 30M, and 30C and ending application of the primary transfer bias to the other primary transfer rolls in accompaniment with the end of primary transfer of the toner images.

However, when the amounts of time that the primary transfer bias is applied to the primary transfer rolls 30Y, 30M, and 30C are different, the amounts of time of the load on the photoconductor drums 22Y, 22M, and 22C become different, so the life spans of the photoconductor drums 22Y, 22M, and 22C become different. However, it is preferable to make the life spans of photoconductor drums as uniform as possible. In particular, it is preferable to make the life spans of the photoconductor drums 22Y, 22M, and 22C uniform.

Thus, next, a method of equalizing the amounts of time that the primary transfer bias is applied to the primary transfer rolls 30Y, 30M, and 30C to equalize the amounts of reduction in the life spans of the photoconductor drums 22Y, 22M, and 22C (a method of making the life spans of the photoconductor drums 22Y, 22M, and 22C uniform) will be described.

The amounts of reduction in the life spans of the photoconductor drums 22Y, 22M, and 22C are proportional to the length (amount of time) of the intermediate transfer belt 46 that passes while the primary transfer bias is applied to the primary transfer rolls 30Y, 30M, and 30C.

Assuming that the timings when the primary transfer bias is ended are the same in a case where the distance between each of the photoconductor drums 22Y to 22K is the same, L represents that distance, and the primary transfer bias continues to be applied to the primary transfer rolls 30Y, 30M, and 30C, then the following becomes true:

amount of reduction in life span of photoconductor drum 22

$Y$ : amount of reduction in life span of photoconductor drum 22

$M$ : amount of reduction in life span of photoconductor drum 22$C$ = distance between photoconductor drums 22$Y$ and

22$K$ : distance between photoconductor drums 22$M$ and

22$K$ : distance between photoconductor drums 22$C$ and 22$K$ = 3

$L$:2$L$:$L$ = 3:2:1.

Consequently, in order to make uniform the amounts of reduction in the life spans of the photoconductor drums 22Y, 22M, and 22C, it suffices for the frequency that the primary transfer bias is applied to the primary transfer rolls 30Y, 30M, and 30C to be such that:

primary transfer roll 30$Y$: primary transfer roll 30$M$: primary transfer roll 30$C$: = 1/3:1/2:1 = 2:3:6.

Moreover, assuming that LYM represents the distance between the photoconductor drums 22Y and 22M, that LMC represents the distance between the photoconductor drums 22M and 22C, and that LCK represents the distance between the photoconductor drums 22C and 22K in a case where the distance between each of the photoconductor drums 22Y to 22K is different, then it suffices for the frequency that the primary transfer bias is applied to the primary transfer rolls 30Y, 30M, and 30C to be such that:

primary transfer roll 30$Y$:primary transfer roll 30$M$: primary transfer roll 30$C$=1/($LYM$+$LMC$+$LCK$): 1/($LMC$+$LCK$):1/$LCK$.

In other words, when the primary transfer bias continues to be applied to any one or two of the primary transfer rolls 30Y, 30M, and 30C even after primary transfer of the toner images from the photoconductor drums 22Y, 22M, and 22C to the intermediate transfer belt 46 ends, then it suffices to set the frequency that the primary transfer bias is applied to the primary transfer rolls 30Y, 30M, and 30C so as to be proportional to the inverse of the distance from the upstream photoconductor drums 22Y, 22M, and 22C to the downstream-most photoconductor drum 22K.

It will be noted that, rather than making reductions in the life spans of all three of the primary transfer rolls 30Y, 30M, and 30C uniform, when reductions in the life spans of just any two of the primary transfer rolls 30Y, 30M, and 30C are to be equalized, it also suffices for the frequency that the primary transfer bias continues to be applied to any two of the primary transfer rolls 30Y, 30M, and 30C to be set so as to be proportional to the inverse of the distance to the downstream-most photoconductor drum 22K.

It will be noted that the amounts of time of application may also be equalized by a method other than what has been described above.

For example, the timings when application ends may be calibrated so that the amounts of time that the primary transfer bias of at least two of the primary transfer rolls 30Y, 30M, and 30C is applied are equalized and so that the amounts of reduction in the life spans of any two of the photoconductor drums 22Y, 22M, and 22C are equalized.

What matters is that it suffices to equalize the amounts of time that the primary transfer bias is applied to at least two of the primary transfer rolls 30Y, 30M, and 30C and to equalize the amounts of reduction in the life spans of any two of the corresponding photoconductor drums 22Y, 22M, and 22C (it suffices to make uniform the life spans of any two of the photoconductor drums 22Y, 22M, and 22C).

Next, a second method of controlling the application timings of the primary transfer bias that controls variations in the speed of the intermediate transfer belt 46 will be described.

Figure 5:
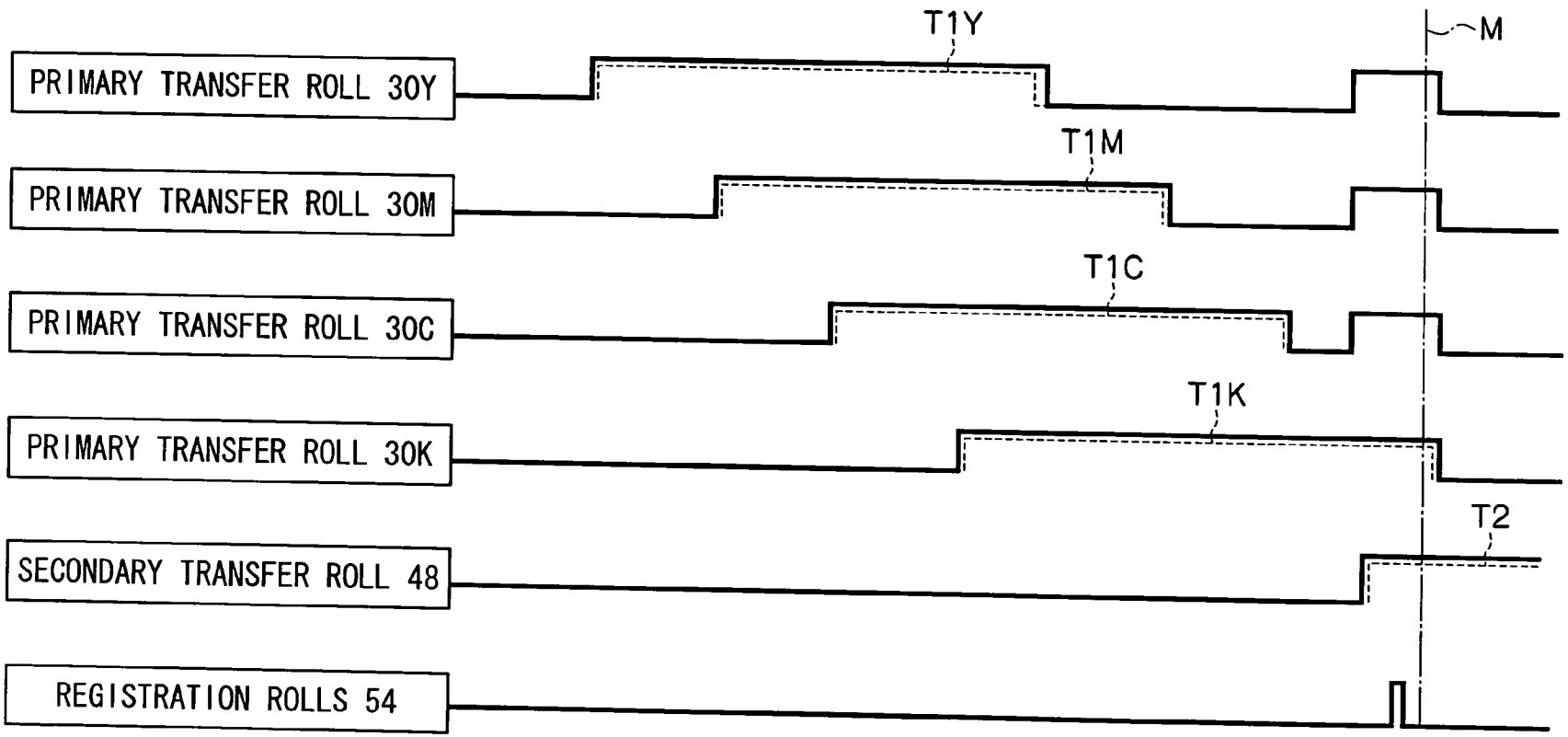
FIG. 5 is a diagram showing a timing chart of a second control method.

FIG. 5 is a timing chart showing the second control method. It will be noted that description that is redundant with the content described in the conventional timing chart (FIG. 8) and the first control method (FIG. 2) will be omitted.

As shown in FIG. 5, application of the primary transfer bias to the primary transfer rolls 30Y to 30K is sequentially started from upstream to primarily transfer the respective color toner images on the photoconductor drums 22Y to 22K to the intermediate transfer belt 46. Additionally, application of the primary transfer bias ends sequentially from upstream as primary transfer (T1Y to T1K) of the toner images on the photoconductor drums 22Y to 22K to the intermediate transfer belt 46 ends. It will be noted that, even after secondary transfer (T2) has started, application of the primary transfer bias continues with respect to just the downstream-most primary transfer roll 30K because primary transfer (T1K) has not ended.

Application of the primary transfer bias ends sequentially from upstream as primary transfer of the respective color toner images of the photoconductor drums 22Y, 22M, and 22C to the intermediate transfer belt 46 ends (T1Y, T1M, T1C), but before the recording medium P enters the nip portion N, the primary transfer bias is again applied to the primary transfer rolls 30Y, 30M, and 30C, and the primary transfer bias is applied until application of the primary transfer bias to the downstream-most primary transfer roll 30K ends.

In other words, as represented by the dashed line M, at the time the recording medium P has entered the nip portion N, the primary transfer bias is being applied to all of the primary transfer rolls 30Y to 30K.

Thus, the brake effect from the photoconductor drums 22Y, 22M, and 22C is maintained without the force of attraction between the intermediate transfer belt 46 and the photoconductor drums 22Y, 22M, and 22C being weakened. In other words, the rotational load is not reduced.

Consequently, variations in the speed of the intermediate transfer belt 46 are controlled even when relatively thick recording medium P enters the nip portion N and shock is imparted. Thus, "banding" is controlled without primary transfer (T1K) from the photoconductor drum 22K to the intermediate transfer belt 46 being disrupted.

In the above description, the timing when application of the primary transfer bias to the downstream-most primary transfer roll 30K ends and the timings when application of the primary transfer bias to the other primary transfer rolls 30Y, 30M, and 30C ends are made substantially the same, but the present invention is not limited to this. The timing when application of the primary transfer bias to the other primary transfer rolls 30Y, 30M, and 30C ends may also be earlier or later than the timing when application of the primary transfer bias to the downstream-most primary transfer roll 30K ends. Further, the timings when application of the primary transfer bias to the primary transfer rolls 30Y, 30M, and 30C ends do not have to be substantially the same (i.e., application of the transfer bias to the primary transfer rolls 30Y, 30M, and 30C may end at separate timings).

What matters is that the primary transfer bias continues to be applied to the other primary transfer rolls 30Y, 30M, and 30C until the recording medium P enters (when the recording medium P has entered) the nip portion N.

Further, the primary transfer bias is again applied to all of the other primary transfer rolls 30Y, 30M, and 30C, but the present invention is not limited to this. It suffices for the primary transfer bias to be applied to any one or more of the primary transfer rolls 30Y, 30M, and 30C.

Figure 6:
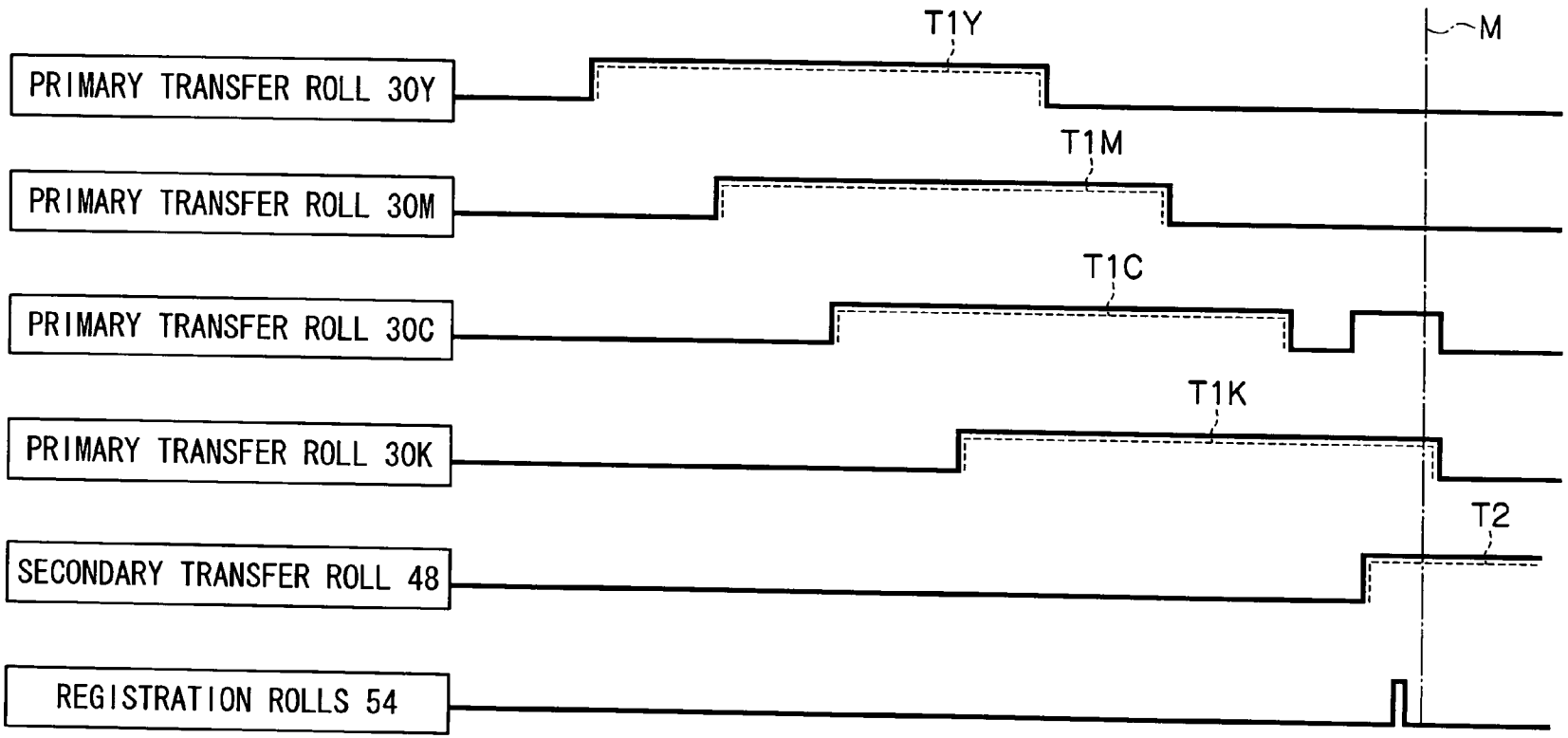
FIG. 6 is a diagram showing a timing chart of a modification of the second control method.
Figure 7:
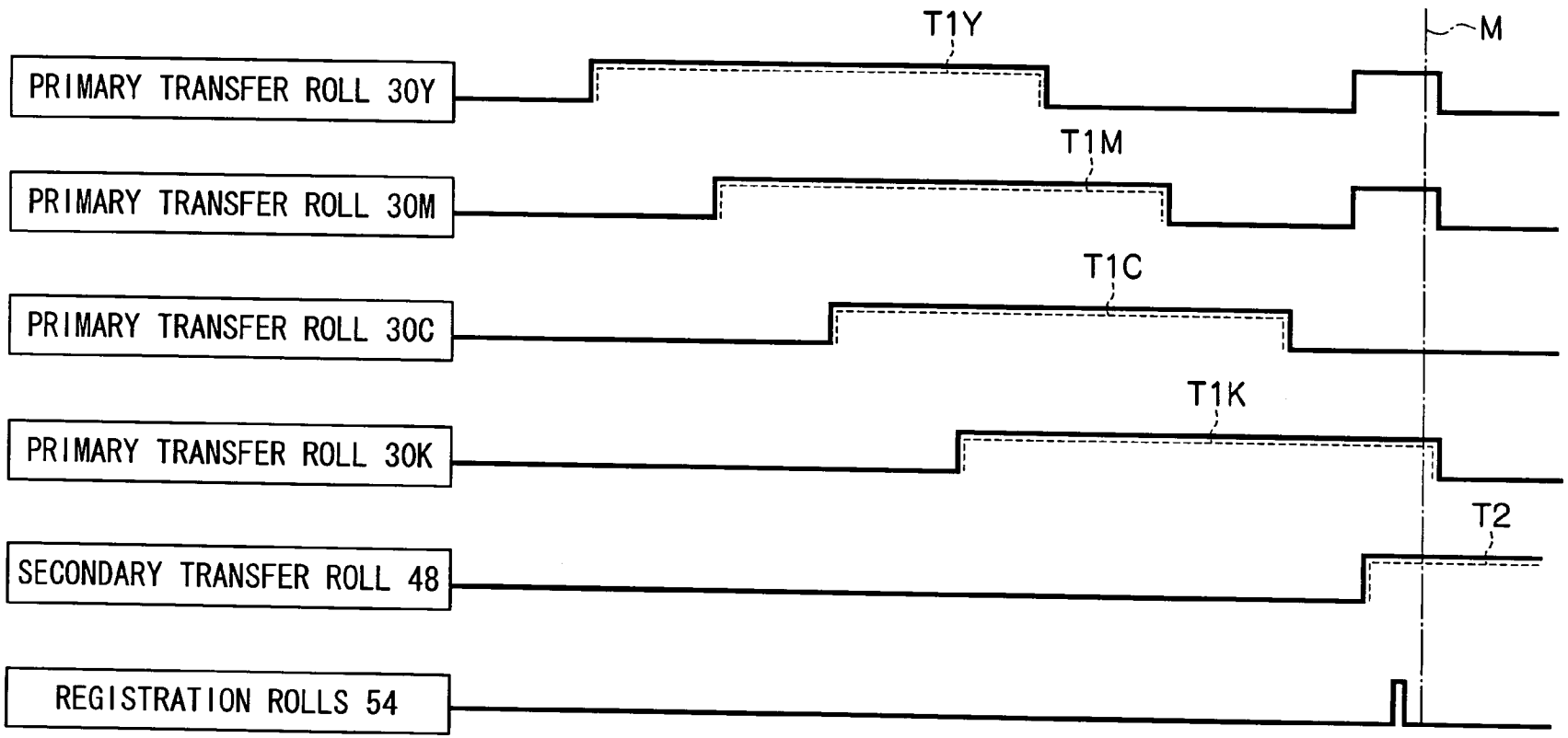
FIG. 7 is a diagram showing a timing chart of a modification of the second control method.

For example, as shown in FIG. 6, the primary transfer bias may again be applied to just the primary transfer roll 30C. Or, as shown in FIG. 7, the primary transfer bias may again be applied to the two primary transfer rolls 30Y and 30M.

In the present control method also, in order to equalize the amounts of time that primary transfer bias is applied to at least two of the primary transfer rolls 30Y, 30M, and 30C, it is preferable to calibrate the frequency and amount of time that the primary transfer bias is again applied to equalize the amounts of reduction in the life spans of at least two of the photoconductor drums 22Y, 22M, and 22C.

The present invention is not limited to the preceding exemplary embodiment.

For example, in the preceding exemplary embodiment, the photoconductor drums were juxtaposed in the order of the photoconductor drum 22Y, the photoconductor drum 22M, the photoconductor drum 22C, and the photoconductor drum 22K, but the present invention is not limited to this. The photoconductor drums may be juxtaposed in any order.

Further, for example, in the preceding exemplary embodiment, the number of photoconductor drums comprised the four photoconductor drums 22Y, 22M, 22C, and 22K, but the present invention is not limited to this. The number of photoconductor drums may also be three or less, or five or more.

Further, for example, in the preceding exemplary embodiment, primary transfer did not end with respect to just the downstream-most primary transfer roll 22K even after secondary transfer began, but the present invention is not limited to this. Application of the primary transfer bias to the downstream-most primary transfer roll 22K may also end when secondary transfer (T2) has begun. In this case, the primary transfer bias may continue to be applied with respect to any two or more of the primary transfer rolls 22Y, 22M, 22C, and 22K until the recording medium P enters the nip portion N even when primary transfer ends. Or, the primary transfer bias may again be applied with respect to any two or more of the primary transfer rolls 22Y, 22M, 22C, and 22K after primary transfer ends and be applied until the recording medium P enters the nip portion N.

What is claimed is:

1. An image forming apparatus comprising:

a plurality of image carriers that carry toner images;

an endless intermediate transfer belt to which the toner images of the plurality of image carriers are sequentially transferred;

a plurality of first transfer members that are disposed in positions facing the image carriers, with the intermediate transfer belt being interposed therebetween, and to which a transfer bias is applied to cause the toner images to be transferred from the image carriers to the intermediate transfer belt;

and a second transfer member that causes the toner images to be transferred from the intermediate transfer belt to a recording medium, the image forming apparatus starting application of the transfer bias sequentially from the first transfer members disposed upstream, after starting application of the transfer bias to a first transfer member disposed most downstream, starting application of the transfer bias to the second transfer members, and continuing to apply the transfer bias to two or more of the first transfer members until the recording medium enters a transfer position where the toner images are transferred by the second transfer member.

2. The image forming apparatus of claim 1, wherein the amounts of time that the transfer bias is applied to two or more of the first transfer members are substantially equal.

3. The image forming apparatus of claim 1, wherein transferring the toner images from the downstream-most image carrier to the intermediate transfer belt continues after the start of transferring the toner images from the intermediate transfer belt to the recording medium, and the image forming apparatus continues to apply the transfer bias to one of the first transfer members other than the first transfer member facing the downstream-most image carrier until the recording medium enters the transfer position where the toner images are transferred by the second transfer member.

4. The image forming apparatus of claim 3, wherein the image forming apparatus continues to apply the transfer bias to one of the first transfer members other than the first transfer member facing the downstream-most image carrier until the recording medium enters the transfer position and also ends application at substantially the same time, and the image forming apparatus sets the frequency of selection of the first transfer members to which the image forming apparatus is to continue to apply the transfer bias so as to be proportional to the inverse of the distance from the upstream image carriers to the downstream-most image carrier.

5. An image forming apparatus comprising:

a plurality of image carriers that carry toner images;

an endless intermediate transfer belt to which the toner images of the plurality of image carriers are sequentially transferred;

a plurality of first transfer members that are disposed in positions facing the image carriers, with the intermediate transfer belt being interposed therebetween, and to which a transfer bias is applied to cause the toner images to be transferred from the image carriers to the intermediate transfer belt; and a second transfer member that causes the toner images to be transferred from the intermediate transfer belt to a recording medium, the image forming apparatus ending application of the transfer bias sequentially from the first transfer members disposed upstream accompanied by the end of transferring the toner images from the image carriers to the intermediate transfer belt and again applies, before the recording medium enters a transfer position where the toner images are transferred by the second transfer member, the transfer bias with respect to at least one of the first transfer members where transfer of the toner images has ended and where application of the transfer bias has ended, with the image forming apparatus continuing to apply that transfer bias until the recording medium at least enters the transfer position.

6. The image forming apparatus of claim 5, wherein the amounts of time that the transfer bias is applied to two or more of the first transfer members are substantially equal.

7. An image forming method in an image forming apparatus, the image forming apparatus including a plurality of image carriers that carry toner images, an endless intermediate transfer belt to which the toner images of the plurality of image carriers are sequentially transferred, a plurality of first transfer members that are disposed in positions facing the image carriers, with the intermediate transfer belt being interposed therebetween, and to which a transfer bias is applied to cause the toner images to be transferred from the image carriers to the intermediate transfer belt, and a second transfer member that causes the toner images to be transferred from the intermediate transfer belt to a recording medium, the image forming method comprising:

starting application of the transfer bias sequentially from the first transfer members disposed upstream;

after starting application of the transfer bias to a first transfer member disposed most downstream, starting application of the transfer bias to the second transfer members; and continuing to apply the transfer bias to two or more of the first transfer members until the recording medium enters a transfer position where the toner images are transferred by the second transfer member.

* * * * *